US008020414B2

(12) United States Patent
Pitisethakarn

(10) Patent No.: US 8,020,414 B2
(45) Date of Patent: Sep. 20, 2011

(54) DEVICE FOR LOCKING CONTAINERS

(75) Inventor: Ekaphan Pitisethakarn, Ratchaburi (TH)

(73) Assignee: Solex International (Thailand) Co., Ltd. (TH)

( * ) Notice: Subject to any disclaimer, the term of this patent is extended or adjusted under 35 U.S.C. 154(b) by 452 days.

(21) Appl. No.: 12/200,799

(22) Filed: Aug. 28, 2008

(65) Prior Publication Data

US 2010/0037664 A1 Feb. 18, 2010

(30) Foreign Application Priority Data

Aug. 14, 2008 (TH) ..... 0801004232

(51) Int. Cl.
*E05B 67/38* (2006.01)

(52) U.S. Cl. ..... 70/14; 70/56; 70/200; 70/212; 70/DIG. 43; 70/DIG. 56; 292/218; 292/258; 292/DIG. 32

(58) Field of Classification Search ..... 70/14, 54–56, 70/DIG. 43, DIG. 56, 200, 203, 212, 417, 70/238, 18, 19; 292/218, 258, 259 R, DIG. 32
See application file for complete search history.

(56) References Cited

U.S. PATENT DOCUMENTS 1,427,285 A * 8/1922 Goehner ..... 70/203
2,541,638 A * 2/1951 Clevett ..... 70/56
2,597,583 A * 5/1952 Holmsten ..... 70/89
3,550,409 A * 12/1970 Pariser ..... 70/203
3,884,057 A * 5/1975 Maurer ..... 70/259
4,003,227 A * 1/1977 Casey ..... 70/14
4,300,373 A * 11/1981 Camos et al. ..... 70/232
4,389,862 A * 6/1983 Hastings ..... 70/2
4,548,058 A * 10/1985 Bahry et al. ..... 70/56
4,574,421 A * 3/1986 Froese ..... 15/339
4,866,960 A * 9/1989 Brower ..... 70/56
5,123,267 A * 6/1992 Appelbaum ..... 70/38 A
5,145,222 A * 9/1992 Meyer ..... 292/258
5,284,036 A * 2/1994 Rosenbaum ..... 70/14
5,544,505 A * 8/1996 McIntosh et al. ..... 70/18
5,746,074 A * 5/1998 Collins ..... 70/18
5,946,952 A * 9/1999 Mintchenko ..... 70/2
6,405,570 B1 * 6/2002 Middleton et al. ..... 70/174
6,467,315 B1 * 10/2002 Edmondson ..... 70/14
6,591,641 B1 * 7/2003 Cann ..... 70/14
6,874,338 B1 * 4/2005 Hunt et al. ..... 70/14
6,983,629 B1 * 1/2006 Gogel ..... 70/14
7,162,898 B2 * 1/2007 Gogel ..... 70/14
7,278,663 B2 * 10/2007 Witchey ..... 292/259 R
7,562,546 B2 * 7/2009 Taylor ..... 70/23
2006/0010939 A1 * 1/2006 Gogel ..... 70/14

* cited by examiner

*Primary Examiner* — Lloyd Gall
(74) *Attorney, Agent, or Firm* — Baker & McKenzie LLP

(57) ABSTRACT

The Container-Locking Device with respect to this particular invention has been designed to fasten the locking upright bar of one door of a container to another. It has been invented to include two virtually symmetrical segments of a pair of locking bar fasteners, where the flat end of each segment, opposite to the end fastened to the container door locking bar, will be fixed to one of the two virtually symmetrical segments of a padlock shroud. There is also a separation-prevention unit which prevents the shroud from being separated and eliminates the gap between the two segments when they are joined, in order to prevent a bolt cutter from being able to be inserted into the padlock shackle.

7 Claims, 3 Drawing Sheets

DEVICE FOR LOCKING CONTAINERS

RELATED APPLICATION

The present application claims priority under 35 U.S.C. §119(a) to Thailand Patent Application No. 0801004232, filed in the Thailand Department of Intellectual Property Office on Aug. 14, 2008, which is incorporated by reference in its entirety as if set forth in full.

BACKGROUND

1. Technical Field

In general, this particular invention relates to anti-theft devices to protect goods stored in containers, and in particular devices for locking containers.

2. Related Art

Many different types of anti-theft devices are used extensively to help prevent goods stored inside a freight container being stolen. One of these is a regular type of lock similar to a hinge and staple set for securing house doors, comprised of a long metal plate fixed to one side of a container's doors, which can be swiveled sideways around the axis it is connected to, like a hinge. The middle section at the end of the independent plate is cut into a rectangular space, through which the U-shape bracket mounted on the other side of the container doors is inserted. The bracket is received by a padlock to secure the metal plate from being pulled off through the bracket. Another type of lock set consists of two long metal plates, each of which are fixed to the locking upright bars on both sides of the container doors. The said locking bars installed on the edges of both container doors can be swiveled sideways around the axis, and can be detached from the freight container. Each independent metal plate is bent perpendicular where the middle area at the end is cut into a hole, so that when they are swung to meet each other, the holes of both plates will be aligned, ready to be received by the padlock. However, both types of locks are unable to secure the padlock shackle from being cut.

SUMMARY

A particular container-locking device fastens the locking upright bar of one container door to the other is described herein. In one aspect, the device includes two virtually symmetrical segments of a pair of locking bar fasteners, where the flat end of each segment is fixed to one of the two virtually symmetrical segments of a padlock shroud. The padlock shroud is also equipped with a separation-prevention unit which prevents the shroud from being separated and eliminates the gap between the two segments when they are joined, so that a bolt cutter cannot be inserted.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION OF THE DRAWINGS

Figure 1:
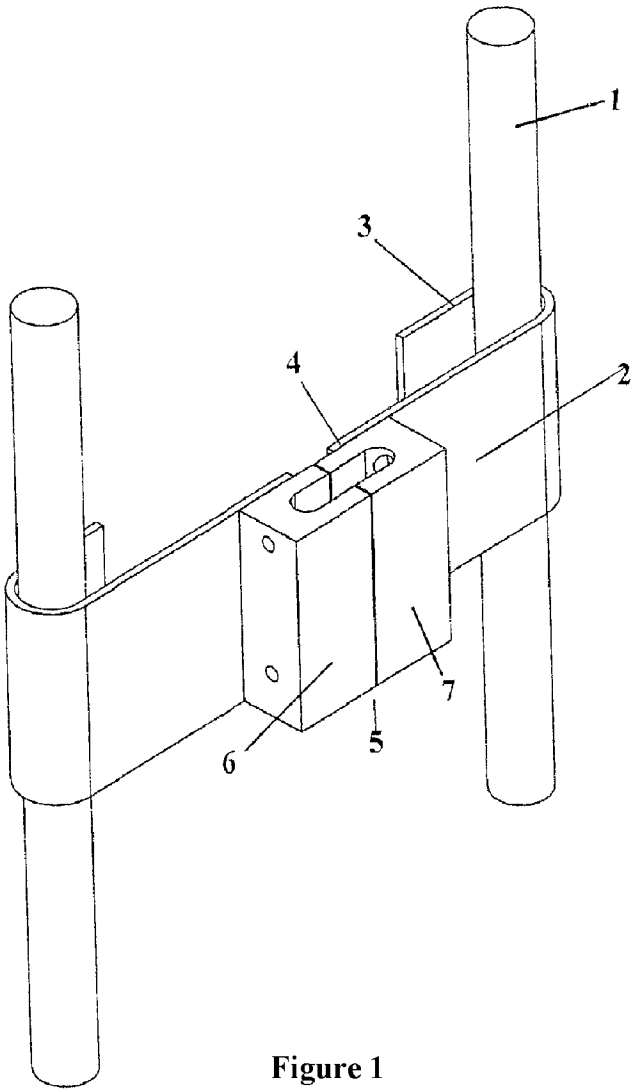
FIG. 1 illustrates the front view of the Container-Locking Device with respect to this particular invention.

FIG. 1 illustrates the front view of the Container-Locking Device configured in accordance with the embodiments described herein. Specifically for use with freight containers with a pair of container door locking bars (1). The mechanism is comprised of a pair of hardened steel, bolt cutter-resistant locking bar fasteners (2). Each locking bar fastener (2) is made of a long, flat metal plate, where one independent end is bent into a U shape (3) to the extent that the radius of the arch corresponds with the radius of the container locking bar (1). The padlock compartment (5), with a height almost equivalent to the width of the locking bar fasteners (2), is divided into two symmetrical padlock compartment segments (6 and 7), where each segment is fixed to the front side of the flat end (4) of each locking bar fastener (2), opposite to the U-shape's independent end (3). The total length of the locking bar fasteners (2) when both sides are connected is consistent with the distance between the two container locking bars (1), installed next to each other.

Figure 2:
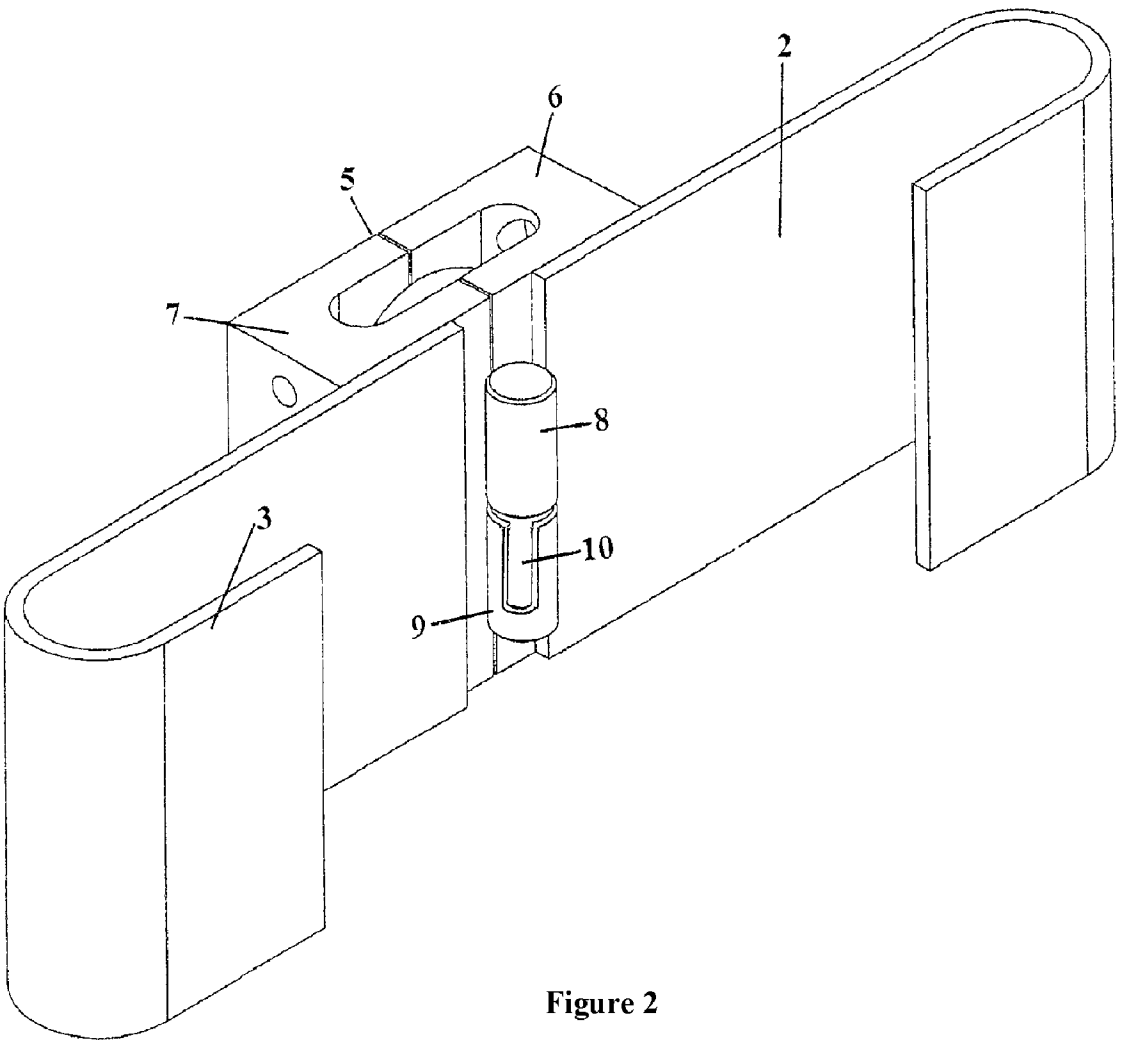
FIG. 2 illustrates the back view of the Container-Locking Device, showing the padlock shroud separation-prevention unit, connected to the back side of the mechanism with respect to this particular invention.

FIG. 2 illustrates the padlock shroud separation-prevention unit included on the back of the device comprising the upper section (8) and the lower section (9), both of which are similar to a cylinder and fixed to the edge of the padlock compartment segments (6 and 7), respectively. The upper cylinder-shape section (8) includes an axis pointing downwards (10) having a diameter less than that of the upper section (8). The lower section (9) is a hollow cylinder with the upper end cut open in order to support the insertion of the axis (10) of the upper section (8). However, the location of the upper section is interchangeable with that of the lower section, meaning the lower section (9) might include an axis pointing upwards, while the upper section (8) might be a hollow cylinder with the lower end cut open in order to support the insertion of the axis of the lower section.

Figure 3:
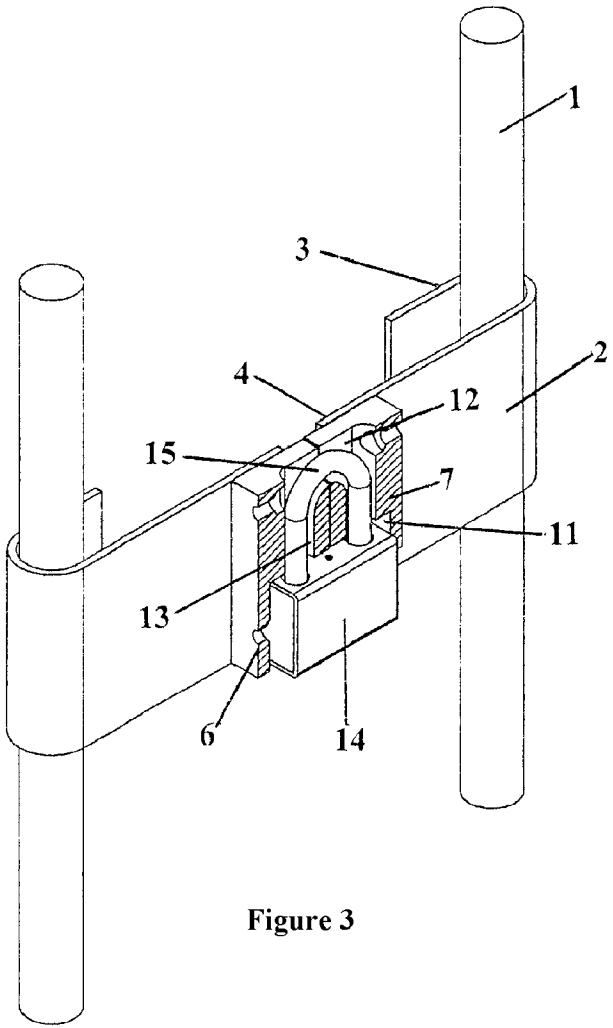
FIG. 3 illustrates the cutaway view of the Container-Locking Device with respect to this particular invention, illustrating the structure of the padlock compartment.

FIG. 3 illustrates a partial cutaway view of the Container-Locking Device of FIGS. 1 and 2, featuring the structure of the padlock compartment (5), with an overall square shape, divided into two symmetrical padlock compartment segments (6 and 7). A concave shaft points downwards (12) inside the upper part of each of the segments 6 and 7; likewise, there is a downward curving shaft (11) inside the lower part of the same. The concaves are made to correspond with the padlock body (14). The hollows (13) are made to create passages between the concaves 12 and the concaves 11, where the size of the hollows corresponds with the size of the padlock shackle (15), in order to support the co-entry of the shackle (15) and the padlock (14), provided that the padlock used to accompany this mechanism must be the kind which the padlock body and the shackle can be separated from each other.

While the foregoing description refers merely to one specimen embodiment of the invention, experts in this field of invention will recognize that this particular invention may be constituted by variations and modifications without departing from the original intention and scope of the invention stipulated under the Claims attached hereto.

The invention claimed is:

1. A container-locking device comprising:

a pair of locking bar fasteners configured to mate with a pair of shipping container locking bars, wherein each locking bar fastener is made from a flat plate, and further wherein each locking bar fastener comprises a flat end opposing a U-shape end, the U-shape ends forming an internal radius that is substantially the same size as the radius of each shipping container locking bar to which each locking bar fastener is mated;

a padlock compartment attached to a front surface at the flat ends of the pair of locking bar fasteners, wherein the padlock compartment has a height substantially equivalent to a width of the pair of locking bar fasteners, and further wherein the padlock compartment is vertically divided into two symmetrical padlock compartment segments; and a padlock shroud separation prevention unit comprising an upper section affixed to a rear surface of a first segment of the padlock compartment and a lower section affixed to a rear surface of a second segment of the padlock compartment, wherein the upper section of the padlock shroud separation prevention unit is configured to mate with the lower section of the padlock shroud separation prevention unit in to prevent the padlock compartment segments from separating;

wherein a total distance between the U-shape ends of the pair of locking bar fasteners is substantially the same distance as the distance between the two shipping container locking bars when both flat ends of the locking bar fasteners are connected to each other via the padlock compartment.

2. The container-locking device of claim 1, wherein the upper section of the padlock shroud separation prevention unit is affixed to an edge of the first padlock compartment segment, is substantially cylindrical in shape, and includes a protrusion pointing downwards from the upper section, the protrusion having a smaller diameter than that of the upper section; and further wherein the lower section of the padlock shroud separation prevention unit is affixed to an edge of the second padlock compartment segment, is substantially cylindrical and hollow in shape, and includes an upper end cut open to receive and mate with the protrusion from the upper section.

3. The container-locking device of claim 1, wherein the lower section of the padlock shroud separation prevention unit is affixed to an edge of the first padlock compartment segment, is substantially cylindrical in shape, and includes a protrusion pointing upwards from the lower section, the protrusion having a smaller diameter than that of the upper section; and further wherein the upper section of the padlock shroud separation prevention unit is affixed to an edge of the second padlock compartment segment, is substantially cylindrical and hollow in shape, and includes a lower end cut open to receive and mate with the protrusion from the lower section.

4. The container-locking device of claim 1, wherein the padlock compartment comprises a hollow section configured to receive a padlock, wherein the hollow section of the padlock compartment comprises a square recess configured to receive a padlock body and an arch-shaped recess configured to receive a padlock shackle, wherein the size of the hollow sections formed in the padlock compartment segments substantially correspond with the size of the padlock to be received.

5. The container-locking device of claim 4, wherein the padlock compartment is of a type where the padlock shackle can be separated from the padlock body.

6. The container-locking device of claim 5, wherein the pair of locking bar fasteners are made of hardened steel.

7. The container-locking device of claim 6, wherein the pair of locking bar fasteners are bolt-cutter resistant.

* * * * *